United States Patent [19]

Wilson

[11] 4,216,818

[45] Aug. 12, 1980

[54] CONTINUOUS CASTING MOLD ASSEMBLY

[75] Inventor: Robert Wilson, Dundee, Scotland

[73] Assignee: Timex Corporation, Waterbury, Conn.

[21] Appl. No.: 958,774

[22] Filed: Nov. 8, 1978

[51] Int. Cl.[3] ..... B22D 11/124

[52] U.S. Cl. ..... 164/443; 164/348

[58] Field of Search ..... 164/89, 443, 444, 118, 164/297, 348, 126, 128, 418, 82

[56] References Cited

U.S. PATENT DOCUMENTS

| | | | |
|---|---|---|---|
| 3,085,303 | 4/1963 | Steigerwald | 164/82 |
| 3,667,248 | 6/1972 | Carlson | 164/128 |

FOREIGN PATENT DOCUMENTS

| | | | |
|---|---|---|---|
| 1303210 | 6/1971 | Fed. Rep. of Germany | 164/443 |

*Primary Examiner*—Robert D. Baldwin
*Assistant Examiner*—K. Y. Lin
*Attorney, Agent, or Firm*—Edward J. Timmer

[57] ABSTRACT

Disclosed is a mold assembly characterized by efficient and controlled removal of heat from molten metal during continuous casting, providing high casting speeds in conjunction with superior surface finish on the cast product. The mold assembly includes a refractory mold body having a longitudinal solidification chamber therein and a plurality of longitudinal cooling bores spaced around the solidification chamber. The cooling bores extend only partially through the mold body in the direction of the solidification chamber to define an insulating section adjacent the inlet end thereof to minimize heat removal from the molten metal source and a cooling section adjacent the outlet end when cooling probes containing a circulating coolant are inserted into the cooling bores. The cooling probes are adjustable along the length of the cooling bores to accurately control the position of the solidification front in the solidification chamber and provide optimum heat transfer from the molten metal for rapid solidification with superior surface finish. In a preferred embodiment, the mold assembly includes a longitudinal bore defining a plurality of solidification chambers of increasing diameter in the direction of the outlet end for producing two or more diameters of cast product by positioning the solidification front first in one chamber and then another by suitable adjustment of the cooling probes.

9 Claims, 10 Drawing Figures

CONTINUOUS CASTING MOLD ASSEMBLY

FIELD OF THE INVENTION

The present invention relates to the continuous casting of metals and, more particularly, to molds for use in such processes.

DESCRIPTION OF THE PRIOR ART

Continuous casting of both ferrous and non-ferrous metals and alloys is a well known technique in the metallurgical art, for example, as represented by the Rossi et al patent, U.S. Pat. No. 3,399,716 issued Sept. 3, 1968, among many others. Of course, in such a dynamic process which transforms hot molten metal into a solid metal shape, the mold in which solidification takes place is extremely important. In the continuous casting of ferrous alloys, water-cooled copper molds have been successfully utilized. On the other hand, for non-ferrous metals and alloys, such as copper, copper base alloys, aluminum, aluminum base alloys and the like, water-cooled graphite molds have met with widespread use, for example, as represented by the Kolle patent, U.S. Pat. No. 3,459,255 issued Aug. 5, 1969 and the Adamec et al patent, U.S. Pat. No. 3,592,259 issued Dec. 10, 1971. As further illustrated in the Woodburn patent, U.S. Pat. No. 3,590,904 issued July 6, 1971, water-cooled graphite molds have also been utilized in casting slabs or ingots of metals or alloys in a non-continuous manner.

In the die casting art, it is known to provide a metallic mold with cooling bores and to insert a cooling probe sealably within each bore for injecting coolant such as liquid carbon dioxide therein, for example, see the Carlson patent, U.S. Pat. No. 3,667,248 issued June 6, 1972. The injection carbon dioxide of course is transformed from the liquid to the gaseous phase by absorption of heat from the mold and the gas is directed by a suitable conduit through the probe to compressor and condensor means for recycling into the cooling bores.

SUMMARY OF THE INVENTION

The present invention provides an improved mold assembly for the continuous casting of metals and alloys characterized by controlled and efficient heat removal from the solidifying metal. As a result, higher casting speeds can be realized with the improved mold assembly in conjunction with improved surface quality of the cast product. In addition, mold life is also appreciably enhanced.

With the aid of a preferred mold assembly of the invention, two or more sizes of cast product can be produced from one mold assembly without interrupting the casting process while still retaining the advantageous features enumerated above.

In a typical embodiment of the present invention, the improved mold assembly includes a refractory mold body having a longitudinal solidification chamber therethrough with an inlet end to receive molten metal from a crucible or other source and an outlet end through which the solidified product exits. An important feature of the improved mold assembly is the provision in the mold body of a plurality of longitudinal cooling bores spaced peripherally around the central solidification chamber, the cooling bores having an open end at the outlet end of the mold body and extending only partially into the mold body in the direction of the inlet end so that an insulating section is defined adjacent the inlet end and a cooling section is adjacent the outlet end of the solidification chamber. Another important feature of the improved mold assembly is the provision of a plurality of elongated cooling probes, each typically comprising an inner feed tube and concentric outer return tube, inside of which a coolant such as water circulates. The cooling probes are adapted for insertion into the cooling bores spaced around the periphery of the solidification chamber to a preselected distance in the direction of the inlet end to accurately control the solidification front within the molten metal at the desired location along the length of the solidification chamber. By providing a peripheral insulating section adjacent the inlet end of the mold body and a peripheral cooling section adjacent the outlet end of the mold body, heat removal from the crucible supplying the molten metal is minimized while heat removal from the molten metal in the cooling section of solidification chamber is maximized, thereby significantly enhancing the heat removal efficiency of the mold assembly. Such increased heat efficiency results in significantly higher casting speeds. In addition, by changing the position of the solidification front relative to the speed of casting by simply moving the cooling probes into or out of the peripheral cooling bores, the surface quality or finish of the cast product can be optimized. Also, periodic changing of the position of the solidification front along the length of the solidification chamber reduces wear of the chamber wall, extending the useful life of the mold body substantially.

These advantages as well as the capability to produce two or more sizes of cast product from a single mold without interrupting the casting process are obtainable with a particular preferred mold assembly which includes as an important feature a longitudinal bore which defines two or more solidification chambers of increasing cross-section, e.g. increasing diameter, toward the outlet end of the mold body. By suitably adjusting the depth of the cooling probes in the peripheral cooling bores, the position of the solidification front within the molten metal can be located in a particular solidification chamber of a first diameter and then in another chamber of a second diameter to produce the desired sizes of cast product. Thus, interruption of the casting process to exchange molds is totally unnecessary.

DESCRIPTION OF THE PREFERRED EMBODIMENTS

Figure 1:
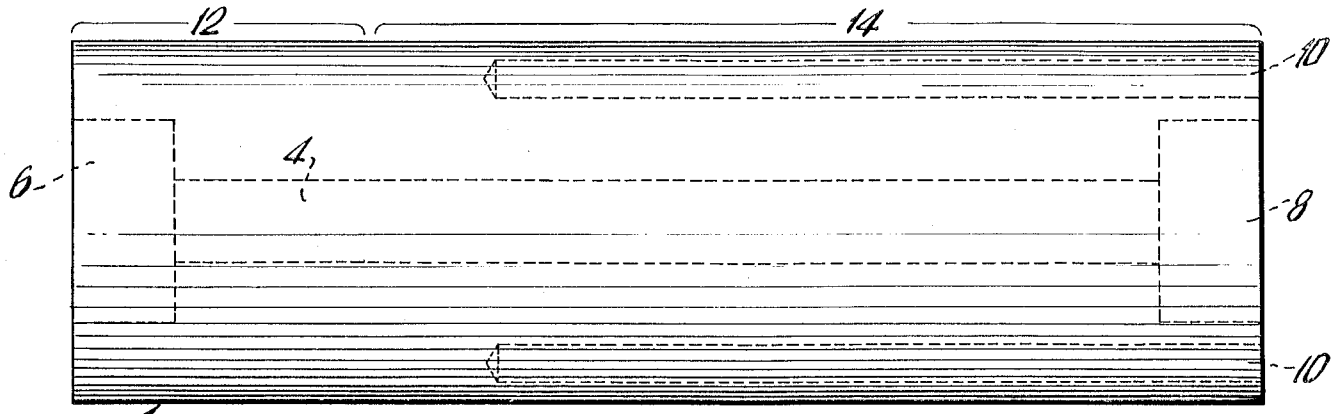
FIG. 1 is a side elevation of the mold body of the invention.
Figure 2:
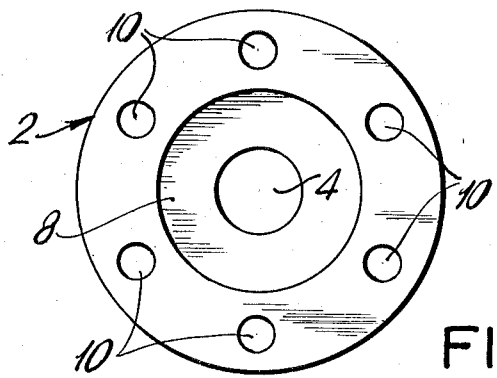
FIG. 2 is an end elevation showing the outlet end of the mold body

Referring first to FIGS. 1 and 2, a typical mold body 2 useful in the invention is illustrated. Although graphite is a preferred material for the mold body, other refractory materials will of course be usable and can be selected as desired depending upon the type of metal or alloy to be cast among other factors. A graphite mold body 2 has proved especially satisfactory in continuously casting leaded brass (60 w/o Cu, 40 w/o Zn, 2 w/o Pb) having a solidification temperature of about 870°-880° C. The mold body 2 includes a central cylindrical bore therethrough which defines a cylindrical solidification chamber 4 for producing a cast bar product, the bore including enlarged ends one of which defines inlet end 6 through which molten metal enters the chamber and outlet end 8 through which the solidified product exits. Inlet end 6 is connected to the discharge nozzle of a conventional crucible (not shown) or other vessel containing the molten metal metal to be continuously cast. The mold body typically is oriented in the horizontal plane although vertical or other orientations are of course possible and well known in the art. Spaced around the circumference or periphery of solidification chamber 4 are a plurality of cylindrical cooling bores 10 which have an open end at the outlet end of the mold body and extend partially into the mold body in the direction of inlet end 6 to provide a peripheral insulating section 12 and peripheral cooling section 14 along the length of the mold body when the cooling probes are inserted therein. As shown, the longitudinal axes of the cooling bores are substantially parallel with the longitudinal axis of the chamber 4. Insulating section 12 is adjacent the inlet end 6 and functions more or less as insulating means between the peripheral cooling section 14 and the crucible containing the hot molten metal to minimize heat removal from the crucible itself and molten metal until it reaches the vicinity of cooling section 14. Cooling section 14 adjacent the outlet end 8 provides highly efficient and concentrated heat removal from the molten and solidifying metal passing therethrough when the cooling probes are inserted in cooling bores 10.

Figure 3:
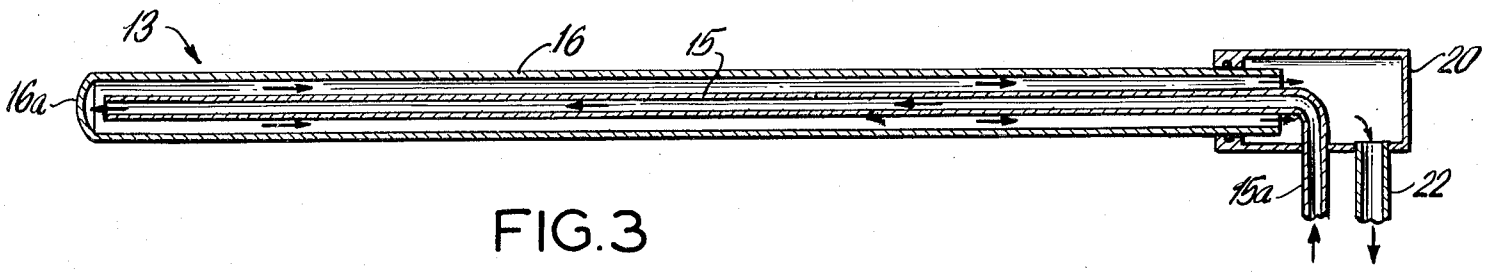
FIG. 3 is a cross-sectional view of a cooling probe of the invention.

A typical cooling probe 13 is shown in cross-section in FIG. 3 as comprising essentially an inner feed tube 15 and concentric outer return tube 16 inside of which coolant, such as water, circulates as indicated by the arrows. As can be seen, the outer return tube 16 includes a closed end 16*a* to seal one end of the cooling probe. At the other end, the tubes penetrate and are sealed within a manifold 20. Feed tube 15 includes an extension 15*a* passing outside the manifold for connection to a coolant supply whereas outer return tube 16 has an open end inside the manifold for discharging the returning coolant therein. Discharge tube 22 conveys the returning coolant from the manifold for cooling and recycling or for disposal. Preferably, feed and return tubes 15 and 16 are made of highly heat conductive metal such as copper although other materials may be utilized.

Figure 4:
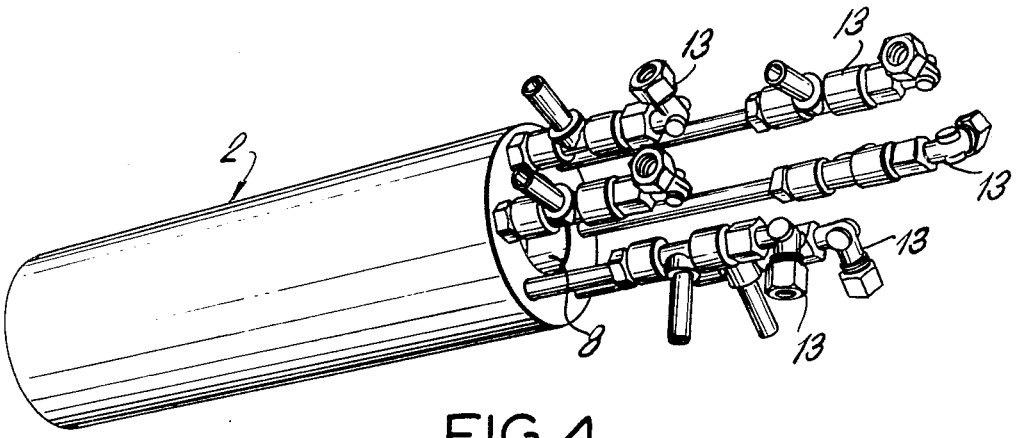
FIG. 4 is a perspective view of the mold assembly of the invention with the cooling probes inserted into the cooling bores of the mold body.

FIG. 4 illustrates a plurality of such cooling probes 13 inserted into cooling bores 10 of the mold body to provide the mold assembly of the present invention. The cooling probes are shown inserted at different distances only for purposes of clarity; generally during casting, all the cooling probes are inserted into the cooling bores to the same distance or depth to assure a uniform solidification front in the molten metal. By adjusting the speed of casting, i.e., speed with which solidified bar is withdrawn from the outlet end 8, and the position of the cooling probes within the cooling bores 10, the location of the solidification front of the molten metal within the solidification chamber, in particular cooling section 14, can be readily adjusted to provide an optimum surface finish on the cast bar product. Of course, the parameters of casting speed and cooling probe insertion distance for production of an optimum surface finish will vary with the chemistry of molten metal or alloy being solidified, the size of the cast product to be produced, the initial temperature of the molten metal and other factors. However, these parameters are readily determinable by simple and well known continuous casting procedures. Generally, for a constant casting speed, the solidification front can be translated toward the inlet end or outlet end by simply increasing or decreasing, respectively, the distance the cooling probes are inserted into cooling bores 10. By using the mold assembly of the invention, very efficient transfer cooling is achieved and the bulk of the cooling is from the liquid/solid bar in a transverse direction with a minimum amount of heat extracted longitudinally. Thus, the metal only in solidification chamber 4 is cooled and heat is not extracted and lost from metal contained in the crucible. As a result, control over the cooling process is considerably improved in conjunction with much improved efficiency. The net effect is that higher casting speeds can be realized while producing a cast product with superior surface finish.

Of course, to optimize heat transfer from the mold body to the cooling probes, the dimensions of the cooling bores and probes must be properly correlated. Cooling bores 10 mm in diameter and cooling probes having a nominal outer diameter (copper return tube outer diameter) of 10 mm have proved satisfactory in this regard. Great care is used in reaming out the cooling bores in the mold body and the outer surface of the cooling probe is coated with colloidal graphite to provide good contact between the cooling probe and cooling bore wall. Of course, these dimensions can be varied as desired depending upon the size of the mold body employed. The aforementioned dimensions have been employed with a cylindrical mold body having a length of 292 mm and a diameter of 90 mm, the solidification chamber therein having a diameter of 21.26 mm.

Figure 5:
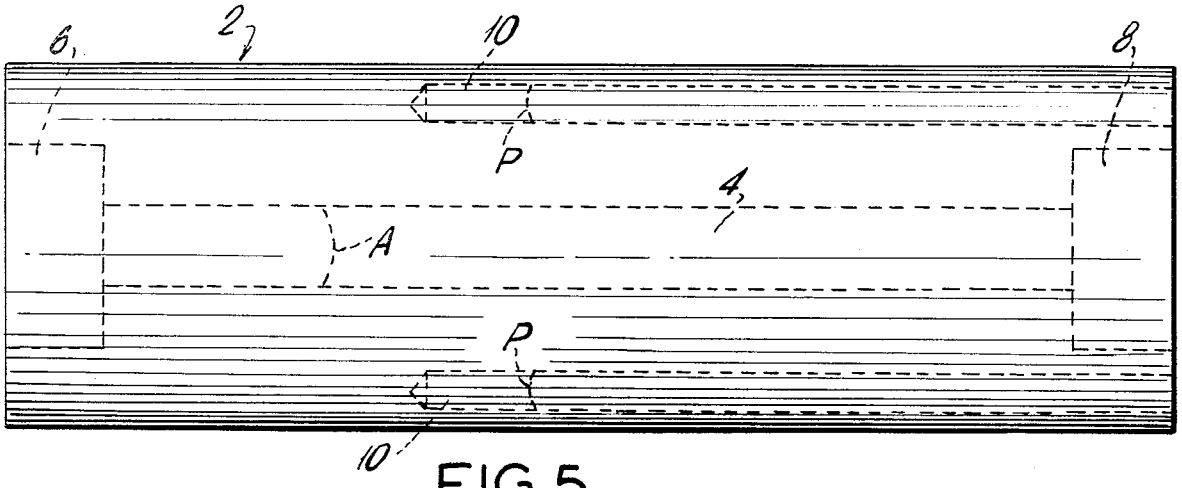
FIGS. 5–8 are schematic side elevations of the mold body showing the position of the cooling probes in the cooling bores and the corresponding position of the solidification front.
Figure 6:
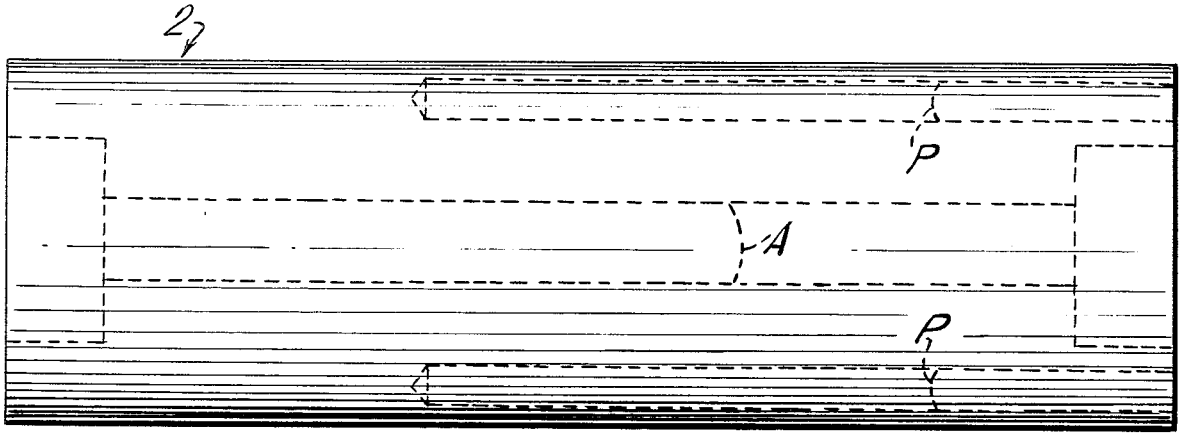
Figure 7:
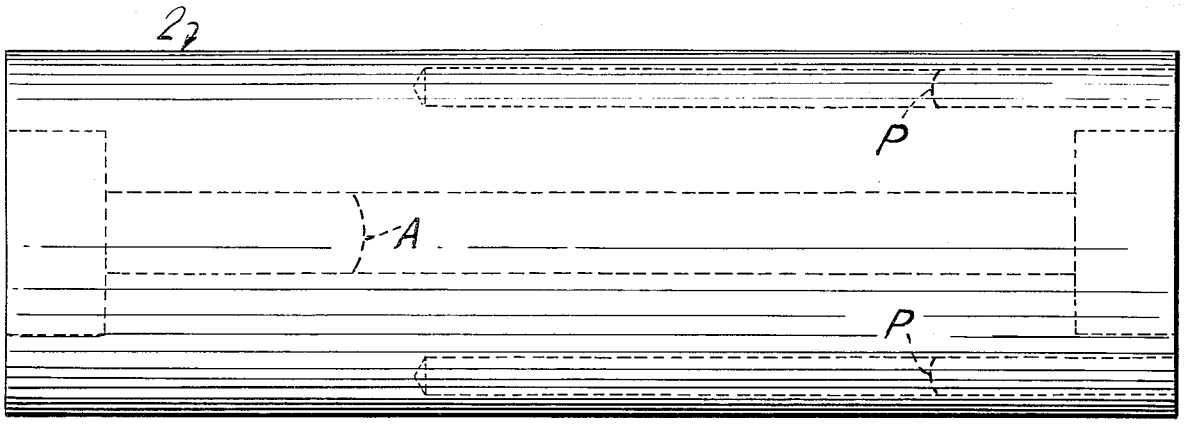
Figure 8:
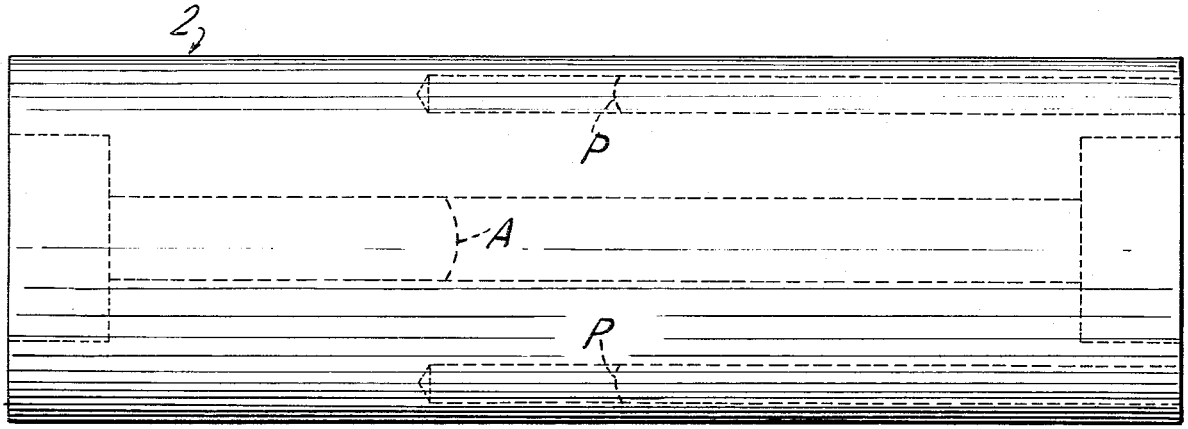

FIGS. 5–8 illustrate somewhat schematically actual casting results obtained with the mold body and cooling probes described in detail hereinabove. In FIGS. 5 and 6, a leaded brass described more fully under International Copper Research Specification Cu Zn 39Pb2 was cast from melt temperatures of about 962° C. and 1025° C., respectively. This alloy has a solidification temperature of about 870°-880° C. The casting speed in each figure was about 14 cm/min with cooling probes inserted so that the probe tips P were 155 mm from the outlet end in FIG. 5 and 60 mm from the outlet end in FIG. 6. The water flow rate in each probe of FIG. 5 was 3.9 liter/min whereas that in each probe of FIG. 6 was 7.15 liter/min. As shown, the solidification front A in FIG. 5 was found to be 216 mm from the outlet end and that in FIG. 6 was only 105 mm from the outlet end. In FIG. 7, the casting speed was 36 cm/min, the probe tips P were inserted 60 mm from the outlet end and the water flow rate was 16.6 liter/min. Under these conditions, the solidification front was 205 mm from the outlet end. In FIG. 8, casting speed was increased to 61 cm/min and the probe tips were inserted farther so that they were 140 mm from the outlet. The water flow rate in the probes was the same as in FIG. 7. The solidification front was determined to be 185 mm from the outlet end in this instance. It should be noted that in all of these casting trials, the surface finish of the resulting solidified bar was excellent, being characterized by a fine-grained surface skin and remelted smooth surface at the pulse interface, and would not require further surface treatment prior to hot stamping or forging. It is believed that the improved heat transfer characteristics of the mold assembly are primarily responsible for the excellent surface finish obtained on the cast product. It is also apparent from the figures that by adjusting the position of the cooling probes within the cooling bores and the casting speed, the location of the solidification front can be varied at will. Variation of the position of the solidification front is extremely useful as a means to reduce wear of the walls of the solidification chamber and thus to considerably increase the life of the mold body.

Figure 9:
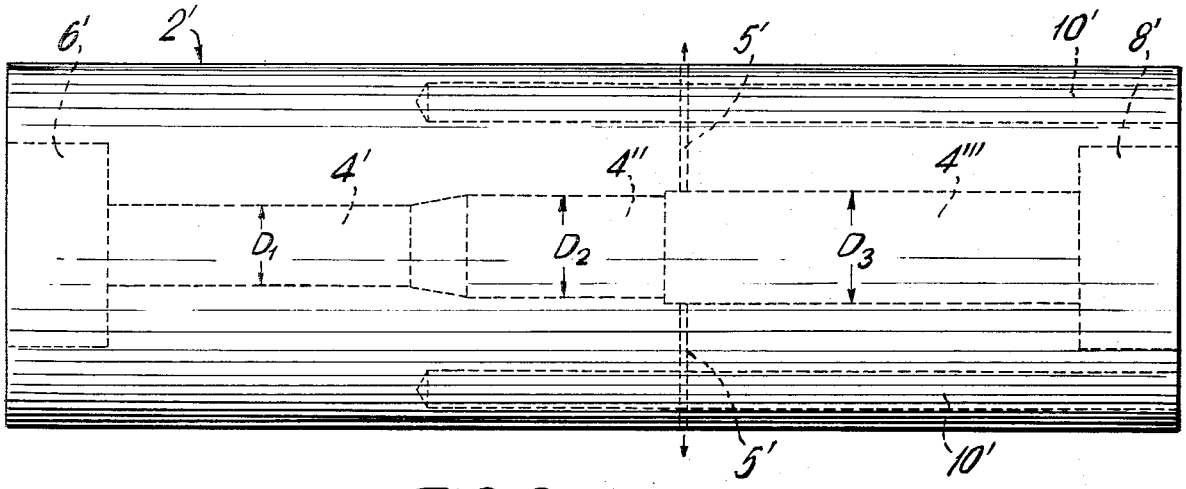
FIG. 9 is a side elevation of the preferred mold body of the invention for producing two diameters of cast bar.

FIG. 9 illustrates a modified mold body 2' for use in a preferred mold assembly of the invention for producing two or more diameters of cast bar product. The notable difference between the modified mold body 2' of FIG. 9 and that shown in FIG. 1 is that the former includes as an important feature a longitudinal bore defining two or more solidification chambers 4', 4'' of increasing diameter $D_1$, $D_2$ toward the outlet end 8' of the mold body. Cooling bores 10' identical to those of FIG. 1 are spaced about the periphery of the central bore and receive cooling probes (not shown) identical to those already described. By adjusting the position of the cooling probes in cooling bores 10' in relation to the casting speed, as described hereinbefore, the solidification front can be located in solidification chamber 4' to produce the smallest diameter cast bar and then can be brought forward by further adjustment toward the outlet end into solidification chamber 4'' to produce larger diameter bars as desired. There is a tapered transition chamber between solidification chambers 4' and 4'' to allow the solidification front to be judiciously repositioned along the length of the mold body during the changeover from casting bar of diameter $D_1$ to bar of diameter $D_2$. It should be noted that bar of smaller diameter $D_1$ can be produced after the larger bars by simply inserting the cooling probes a greater distance into the cooling bores. Thus with the multiple solidification chambers, it is possible to continuously cast one diameter in required tonnage and then others in required tonnages without changing molds or interrupting the flow of molten metal. For purposes of illustration, typical values of $D_1$ and $D_2$ might be 21.26 mm and 26.16 mm, respectively.

Figure 10:
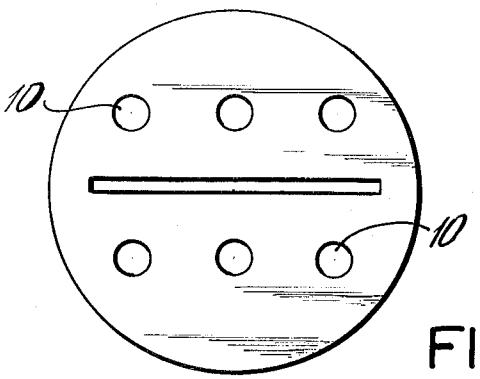
FIG. 10 is an end elevation of a mold body of the invention for producing a solidified product with a rectangular cross-section.

Another notable modification to mold body 2' of FIG. 9 is the provision for injection of a gaseous and possibly liquid coolant into the exit chamber 4''' and through the static air gap formed between the solidified bar and chamber wall as a result of solidification shrinkage upon casting most metals. The coolant then flows out radial discharge passages 5'. This flow of coolant, preferably an inert gas such as nitrogen, is advantageous since it considerably increases the rate of heat transfer from the solid hot bar. A pressurized gas cylinder of nitrogen provides a useful means for introducing the inert gas coolant into chamber 4''', although other injection means may be employed. In the embodiment thus far described, exit chamber 4''' typically would have a diameter $D_3$ of 28.16 mm. By making diameter $D_3$ greater than $D_2$, the so-called static air gap is effectively enlarged and thereby facilitates flow of the coolant therethrough. Although the mold assembly of the invention has been described in detail as it relates to the production of a cast bar product of circular cross-section, it is apparent that other product shapes can be produced with the mold assembly by suitable modification to the shape of the solidification chamber. For example, FIG. 10 illustrates one type of mold body useful for producing a cast product of rectangular cross-section. Other cooling probe constructions may be utilized so long as they are adapted to be moved in and out of the cooling bores and to provide sealed, circulating coolant therein. Of course, other modifications will occur to those skilled in the art and it is desired to cover in the appended claims all such modifications as fall within the true spirit and scope of the invention.

I claim:

1. A mold assembly for continuously casting molten metal, comprising:

(a) a mold body having a longitudinal solidification chamber therethrough with an inlet end for receiving molten metal from a molten metal source and an outlet end through which solidified metal exits and having a plurality of longitudinal cooling bores spaced around the solidification chamber, the cooling bores each having an open end on the outlet end of the mold body and extending only partially therethrough toward the inlet end to define an insulating section adjacent said inlet end and a peripheral cooling section adjacent said outlet end, said insulating section extending sufficiently along the length of the mold body to minimize heat removal from the molten metal source and molten metal itself until the metal reaches the cooling section where heat removal is locally concentrated and controlled, and (b) a plurality of elongated closed-end cooling probe means adapted for insertion into the open ends of said cooling bores to provide contact cooling to said peripheral cooling section and moveable into and out of said open ends during casting so as to be adjustable in position along the length of said cooling bores for locally controlling and concentrating heat removal from the molten metal and locating the solidification front within the molten metal at a selected position in the solidification chamber for development of optimum heat transfer and casting surface finish at a given casting speed and molten temperature and chemistry and for reduction of wear of the solidification chamber, if necessary, by periodic repositioning of the solidification front.

2. The mold assembly of claim 1 wherein said longitudinal solidification chamber is a cylindrical bore.

3. The mold assembly of claim 2 wherein the longitudinal cooling bores are spaced around the circumference of said solidification bore, the longitudinal axes of said cooling bores being substantially parallel with the longitudinal axis of said solidification bore.

4. The mold assembly of claim 1 wherein each cooling probe comprises an inner feed tube and concentric outer return tube for circulation of coolant therethrough.

5. The mold assembly of claim 1 wherein the mold body is graphite.

6. A mold assembly for continuously casting molten metal into multiple, product sizes without interruption of the casting process comprising:

(a) a mold body having a longitudinal solidification chamber therethrough with an inlet end for receiving molten metal from a molten metal source and an outlet end through which solidified metal exits, the solidification chamber having an increasing cross-section along its length toward said outlet end, said mold body having a plurality of longitudinal cooling bores spaced around the solidification chamber, the cooling bores each having an open end on the outlet end of the mold body and extending only partially therethrough toward the inlet end to define an insulating section adjacent said inlet end and a peripheral noninsulating, cooling section adjacent said outlet end, said insulating section extending sufficiently along the length of the mold body to minimize heat removal from the molten metal source and molten metal itself until the metal reaches the cooling section where heat removal can be locally concentrated and controlled, and (b) a plurality of elongated closed-end cooling probe means adapted for insertion into the open ends of said cooling bores to provide contact cooling to said peripheral cooling section and moveable into and out of said open ends during casting so as to be adjustable in position along the length of said cooling bores for locally controlling and concentrating heat removal from the molten metal and locating the solidification front within the molten metal successively at selected positions in the solidification chamber having different cross-sections so that a cast product with a first cross-section can be produced in desired amount followed by additional cast products with other cross-sections in desired amounts without exchanging the mold.

7. The mold assembly of claim 6 wherein the solidification chamber comprises at least two distinct chambers of desired cross-section separated from one another by a tapered transition chamber.

8. The mold assembly of claim 7 wherein said distinct chambers are cylindrical bores of different diameter.

9. The mold assembly of claim 6 wherein each cooling probe comprises an inner feed tube and concentric outer return tube for circulation of coolant therethrough.

* * * * *

UNITED STATES PATENT AND TRADEMARK OFFICE

CERTIFICATE OF CORRECTION

PATENT NO. : 4,216,818

DATED : August 12, 1980

INVENTOR(S) : Robert Wilson

It is certified that error appears in the above-identified patent and that said Letters Patent are hereby corrected as shown below:

Column 1, line 36: change "injection" to -- injected --,

IN THE CLAIMS

Claim 1, line 50: after "molten", insert -- metal --.

Signed and Sealed this

*Eighteenth* Day of *November 1980*

[SEAL]

*Attest:*

SIDNEY A. DIAMOND

*Attesting Officer*

*Commissioner of Patents and Trademarks*